US011217922B2

(12) United States Patent
Chin

(10) Patent No.: US 11,217,922 B2
(45) Date of Patent: Jan. 4, 2022

(54) ADAPTOR FOR FLEXIBLE FLAT CABLE

(71) Applicant: Energy Full Electronics Co., Ltd, New Taipei (TW)

(72) Inventor: Hsu-Shen Chin, New Taipei (TW)

(73) Assignee: Energy Full Electronics Co., Ltd, New Taipei (TW)

( * ) Notice: Subject to any disclaimer, the term of this patent is extended or adjusted under 35 U.S.C. 154(b) by 65 days.

(21) Appl. No.: 16/706,897

(22) Filed: Dec. 9, 2019

(65) Prior Publication Data

US 2020/0185848 A1 Jun. 11, 2020

(30) Foreign Application Priority Data

Dec. 11, 2018 (TW) ..... 107216834

(51) Int. Cl.

| | |
|---|---|
| ***H01R 12/00*** | (2006.01) |
| ***H01R 12/77*** | (2011.01) |
| ***H01R 12/79*** | (2011.01) |
| ***H01R 12/59*** | (2011.01) |

(52) U.S. Cl.
CPC ..... *H01R 12/777* (2013.01); *H01R 12/592* (2013.01); *H01R 12/79* (2013.01)

(58) Field of Classification Search
CPC .... H05K 3/365; H05K 1/118; H01R 13/6658; H01R 12/79; H01R 13/5833; H01R 13/506; H01R 12/777; H01R 12/592
USPC ... 439/67, 76.1, 77, 456, 459, 465, 466, 493
See application file for complete search history.

(56) References Cited

U.S. PATENT DOCUMENTS

| | | | | |
|---|---|---|---|---|
| 3,795,885 | A * | 3/1974 | Desso | H01R 12/79 439/67 |
| 4,578,697 | A * | 3/1986 | Takemae | H01L 23/057 257/703 |
| 5,193,545 | A * | 3/1993 | Marsoner | A61B 5/14528 128/DIG. 13 |
| 6,120,319 | A * | 9/2000 | Lee | H01R 12/675 439/405 |
| 7,018,231 | B2 * | 3/2006 | Liu | H01R 12/592 439/492 |
| 7,601,010 | B1 * | 10/2009 | Wu | H01R 13/6658 439/76.1 |
| 7,794,273 | B2 * | 9/2010 | Xu | H01R 13/621 439/555 |
| 7,798,821 | B2 * | 9/2010 | Liu | H01R 13/6658 439/76.1 |
| 7,874,867 | B2 * | 1/2011 | Takahashi | H01R 12/777 439/496 |
| 8,512,071 | B2 * | 8/2013 | Tseng | H01R 13/6658 439/493 |
| 8,585,433 | B2 * | 11/2013 | Honda | H01R 24/62 439/499 |

(Continued)

*Primary Examiner* — Thanh Tam T Le

(57) ABSTRACT

An adaptor includes a substrate, a first housing, and a flat cable. The substrate comprises a terminal hole. The first housing includes a first insertion hole and a second insertion hole. The substrate is inserted into the first insertion hole. The flat cable includes a plurality of conductors. Each of the conductors includes a conductor terminal. The flat cable passes through the second insertion hole. The conductor terminal is connected to the terminal hole. A direction in which the substrate is inserted into the first insertion hole is perpendicular to a direction in which the flat cable passes through the second insertion hole.

8 Claims, 12 Drawing Sheets

(56) References Cited

U.S. PATENT DOCUMENTS

| | | | | |
|---|---|---|---|---|
| 8,672,689 | B2 * | 3/2014 | Tseng | H01R 24/62<br>439/76.1 |
| 8,758,030 | B2 * | 6/2014 | Chen | H01R 12/62<br>439/76.1 |
| 8,845,341 | B2 * | 9/2014 | Chen | H01R 13/516<br>439/76.1 |
| 9,033,744 | B2 * | 5/2015 | Chen | H01R 12/721<br>439/660 |
| 9,225,090 | B2 * | 12/2015 | Chen | H01R 12/79 |

* cited by examiner

ADAPTOR FOR FLEXIBLE FLAT CABLE

RELATED APPLICATIONS

This application claims the benefit of priority of Taiwanese Patent Application No. 107216834 filed on Dec. 11, 2018, the contents of which are incorporated herein by reference in their entirety.

FIELD AND BACKGROUND OF THE INVENTION

The present disclosure relates to an adaptor, more particularly, to an adaptor for a flexible flat cable.

A flexible flat cable (FFC) generally refers to an ultra-thin flat cable commonly found in high-density electronic products, such as notebook computers and mobile phones, etc. Because its electrical conducting lines have the characteristics of being flexible and bendable, the flexible flat cable is widely used in various related electronic products. A printed circuit board (PCB) has many large and small holes on it, which can be roughly classified into two types: a plating through hole (PTH) and a non-plating through hole (NPTH). PTHs are mainly used for soldering pins of traditional parts, and the diameters of these holes need to be slightly larger than the diameters of the soldered pins of the parts to allow the parts to be inserted into the holes for soldering. The diameters of the NPTHs are usually larger than those of the PTHs. This is because most of the NPTHs are used for locking screws, and some of them are used for mounting and fixing some connectors that are connected the outside.

SUMMARY OF THE INVENTION

One objective of the present disclosure is to provide an adaptor. The flexible flat cable in the adaptor and the printed circuit board are perpendicularly connected and are fixed by using a housing. As a result, the overall height of the product is reduced and the length of the flexible flat cable is shortened.

An adaptor according to the embodiment of the present disclosure comprises a substrate, a first housing, and a flat cable. The substrate comprises a terminal hole. The first housing comprises a first insertion hole and a second insertion hole. The substrate is inserted into the first insertion hole. The flat cable comprises a plurality of conductors. Each of the conductors comprises a conductor terminal. The flat cable passes through the second insertion hole. The conductor terminal is connected to the terminal hole. A direction in which the substrate is inserted into the first insertion hole is perpendicular to a direction in which the flat cable passes through the second insertion hole.

Optionally, the first housing further comprises a pair of protrusions in it, the pair of protrusions hold the flat cable.

Optionally, two abutting portions are respectively disposed on two surfaces of the substrate, each of the abutting portions is used for mating a slot of a device.

Optionally, the adaptor further comprises a second housing. The second housing being disposed in the first housing, the second housing comprising a third insertion hole.

Optionally, the second housing further comprises a fourth insertion hole. The conductor terminal passes through the fourth insertion hole to be connected to the terminal hole.

Optionally, the flat cable passes through the second insertion hole and the third insertion hole, the conductor terminal is connected to the terminal hole.

Optionally, the substrate further comprises an opening, the second housing further comprises a positioning pillar, the positioning pillar passes through the opening.

Optionally, the first housing further comprises a pair of protrusions in it, the pair of protrusions hold the flat cable.

Optionally, the second housing further comprises a pair of recesses, the pair of protrusions are inserted into the pair of recesses to hold the flat cable.

As compared with the related art, not only can the adaptor according to the present disclosure reduce the height of the product, but the length of the flexible flat cable is also shortened. This is because when the direction in which the substrate is inserted into the first insertion hole is perpendicular to the direction in which the flat cable passes through the second insertion hole, the flat cable can be directly connected to the terminal holes on the substrate without being bent. As a result, the length required for the flexible flat cable is shortened to eliminate the space and height required by bending.

BRIEF DESCRIPTION OF THE SEVERAL VIEWS OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF SPECIFIC EMBODIMENTS OF THE INVENTION

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures.

Figure 1:
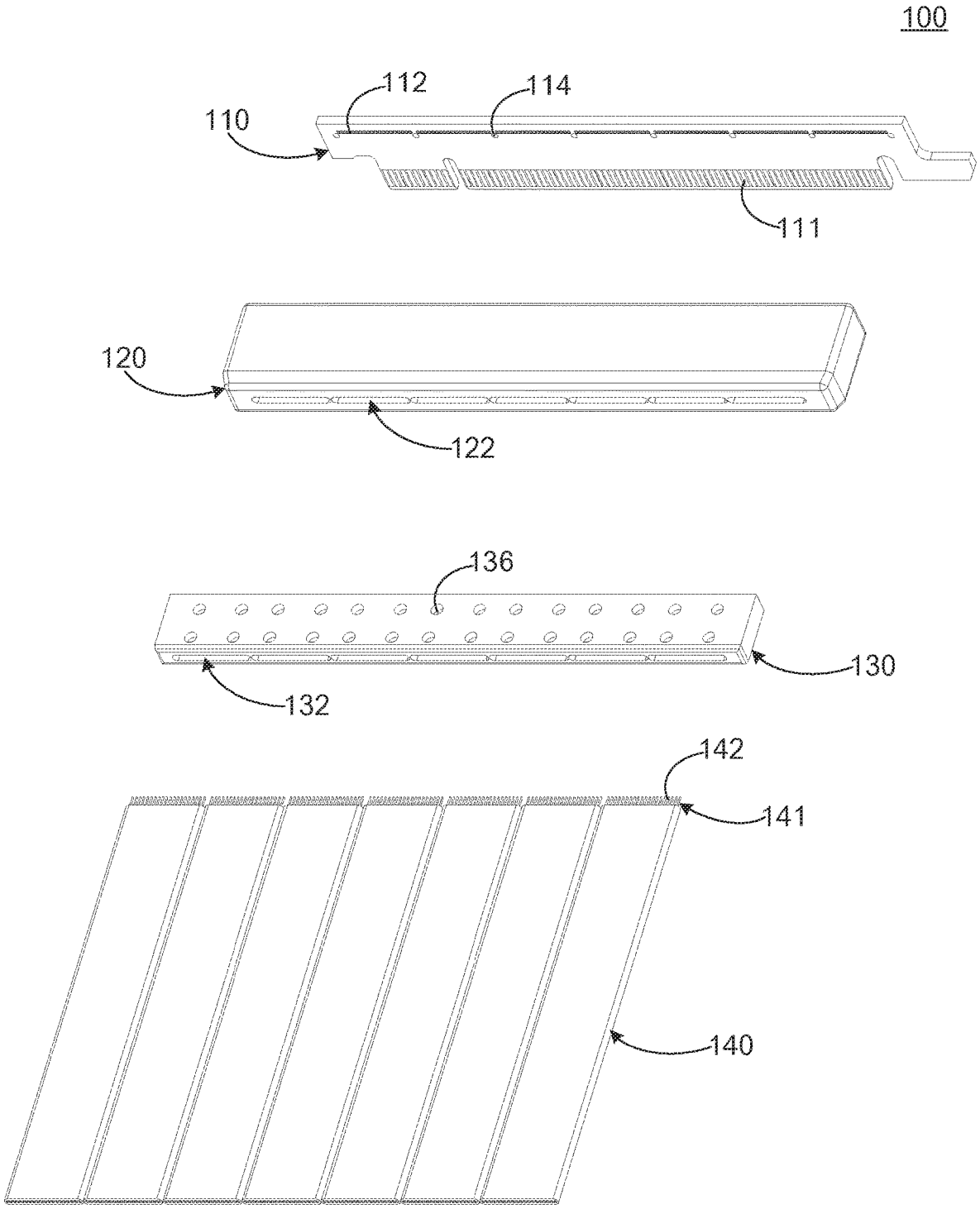
FIG. 1 and FIG. 2 are exploded views of an adaptor viewed from two opposite view angles according to a preferred embodiment of the present disclosure.
Figure 2:
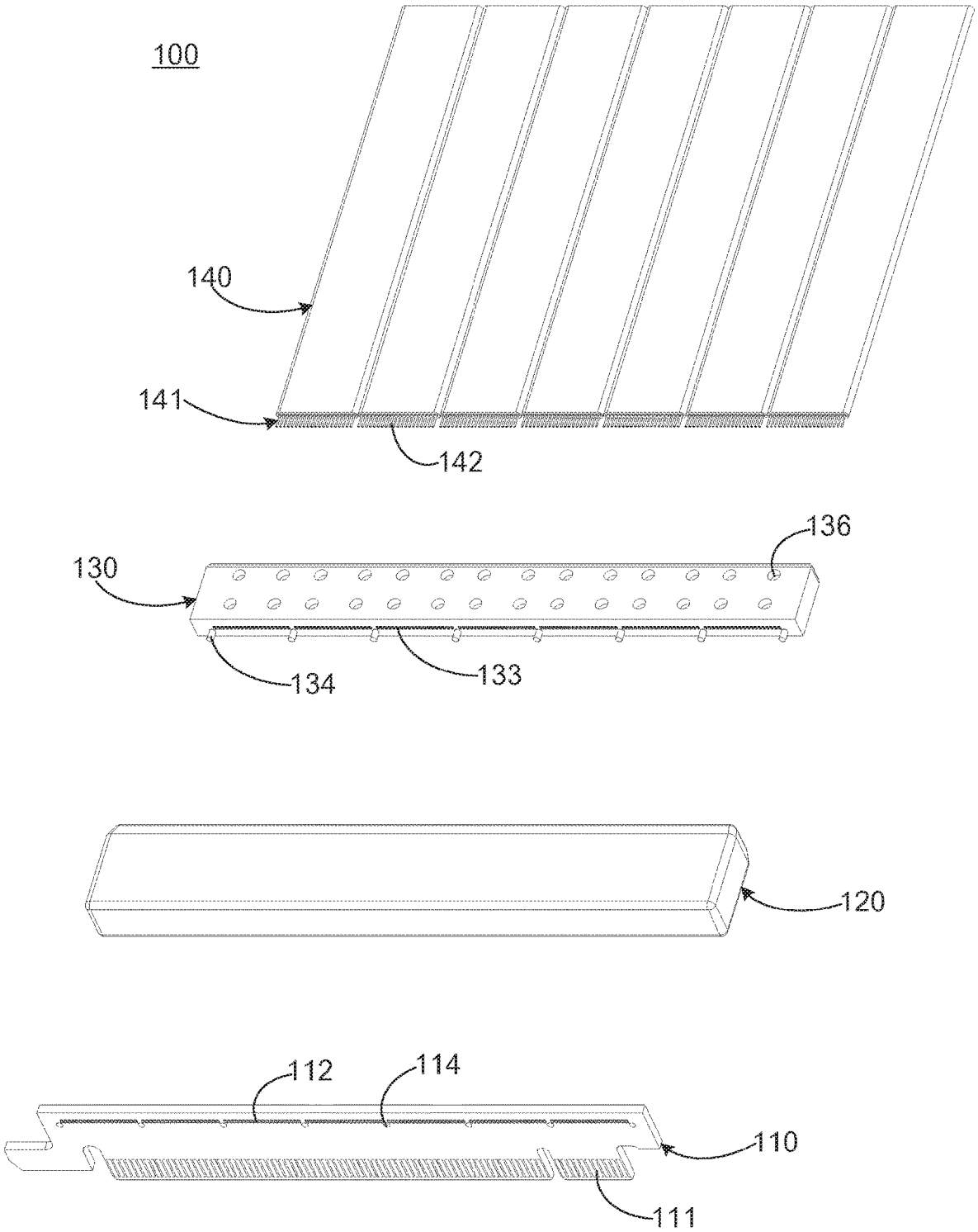
Figure 10:
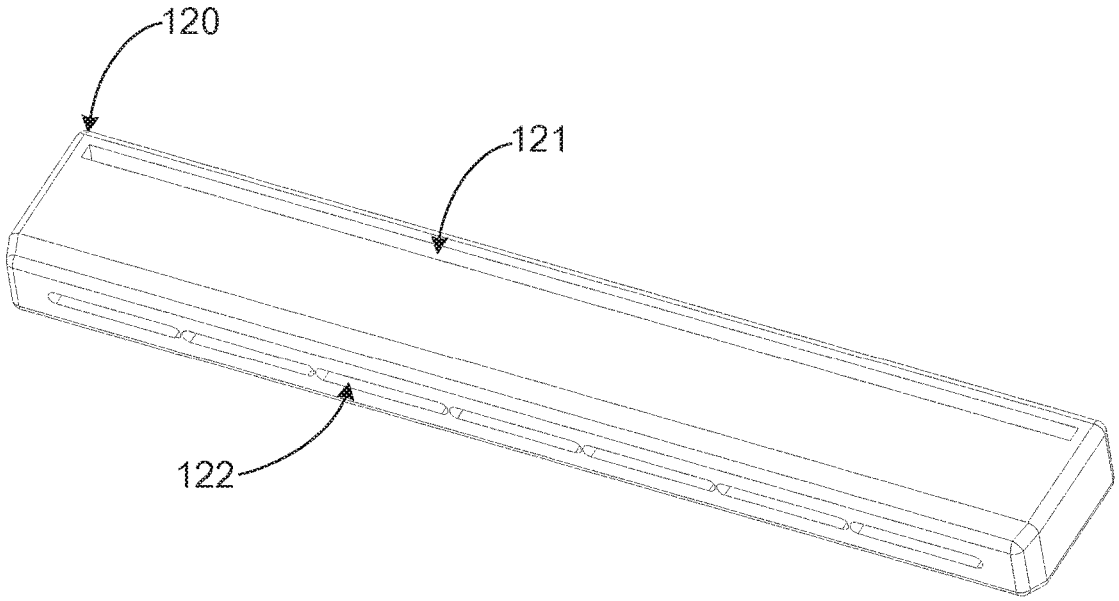
FIG. 10 is a perspective view of the first housing in FIG. 9 view from another view angle.

A description is provided with reference to FIG. 1, FIG. 2 and FIG. 10. FIG. 1 and FIG. 2 are exploded views of an adaptor 100 viewed from two opposite view angles according to a preferred embodiment of the present disclosure. FIG. 10 is a perspective view of a first housing 120 view from another view angle. The adaptor 100 comprises a substrate 110, the first housing 120, a second housing 130 and a flat cable 140. The substrate 110 comprises an abutting portion 111, terminal holes 112 and openings 114. Each of the abutting portions 111 is used for mating a slot of a device. The first housing 120 comprises a first insertion hole 121 and a second insertion hole 122. The second housing 130 comprises a third insertion hole 132, a fourth insertion hole 133, positioning pillars 134, and recesses 136. The flat cable 140 comprises a plurality of conductors 141. Each of the conductors 141 comprises a conductor terminal 142. The substrate 110 is inserted into the first housing 120 from the first insertion hole 121 of the first housing 120. The flat cable 140 passes through the third insertion hole 132 of the second housing 130 and the second insertion hole 122 of the first housing 120. The conductor terminals 142 of the flat cable 140 pass through the fourth insertion hole 133 of the second housing 130. The conductor terminals 142 are connected to the terminal holes 112 of the substrate 110. The positioning pillars 134 of the second housing 130 are inserted into the openings 114 on the substrate 110 for fixing the flat cable 140 and the substrate 110. A direction in which the substrate 110 is inserted into the first insertion hole 121 is perpendicular to a direction in which the flat cable 140 passes through the second insertion hole 122 and the third insertion hole 132.

Figure 3:
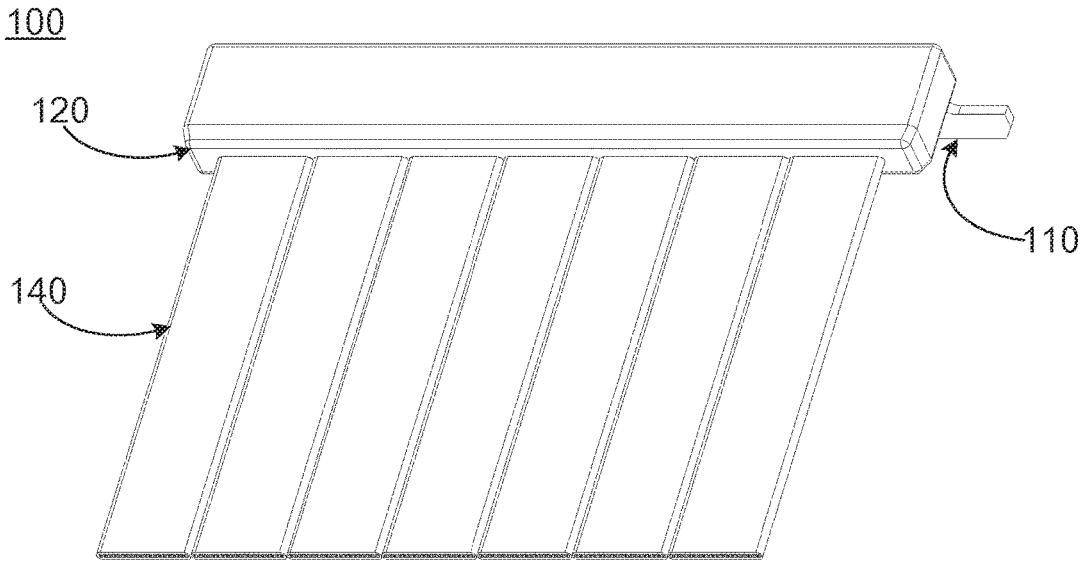
FIG. 3 and FIG. 4 are perspective views of an adaptor viewed from two opposite view angles after being assembled according to a preferred embodiment of the present disclosure.
Figure 4:
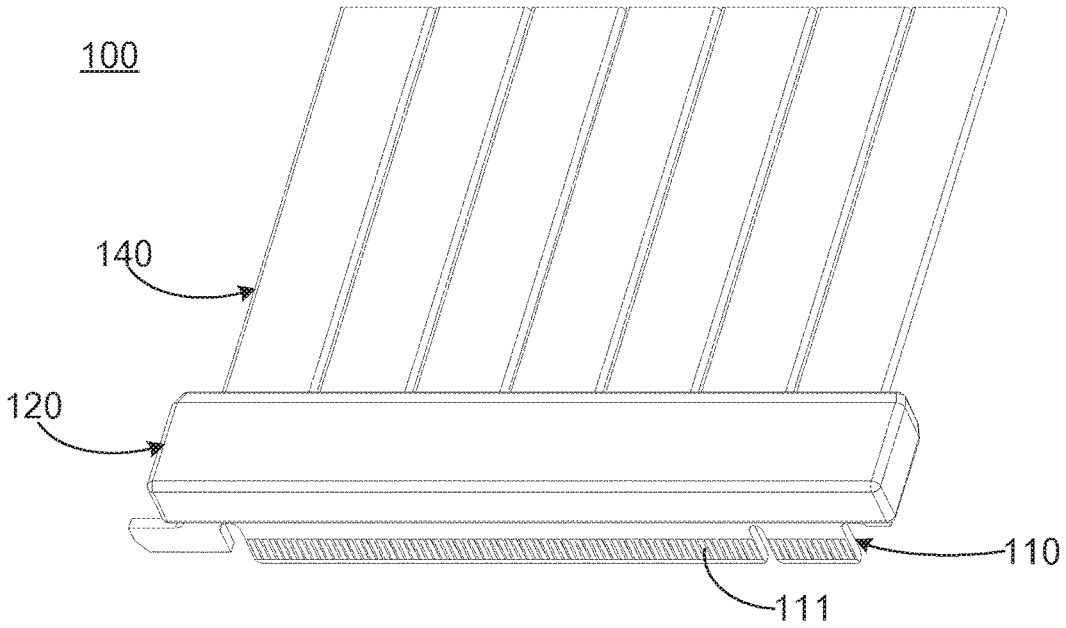

A description is provided with reference to FIG. 3, FIG. 4 and FIG. 10. FIG. 3 and FIG. 4 are perspective views of the adaptor 100 viewed from two opposite view angles according to a preferred embodiment of the present disclosure. The adaptor 100 comprises the substrate 110, the first housing 120 and a flat cable 140. The substrate 110 is inserted into the first insertion hole 121 of the first housing 120. The flat cable 140 is inserted into the second insertion hole 122 of the first housing 120. The direction in which the substrate 110 is inserted into the first insertion hole 121 is perpendicular to the direction in which the flat cable 140 passes through the second insertion hole 122.

Figure 5:
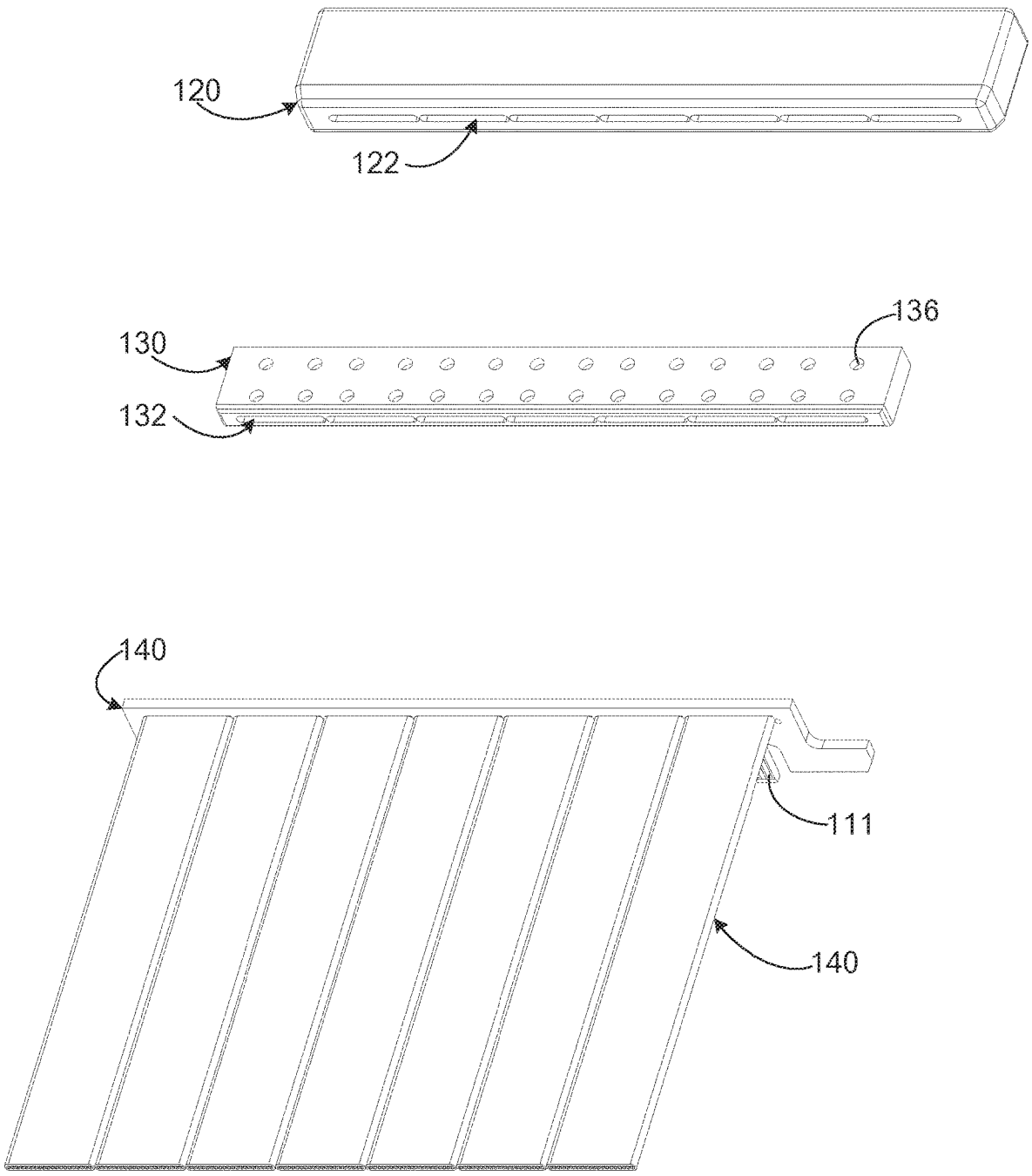
FIG. 5 and FIG. 6 are structural views of the adaptor viewed from two opposite view angles when the flat cable is connected to the substrate in the exploded views of FIG. 1 and FIG. 2.
Figure 6:
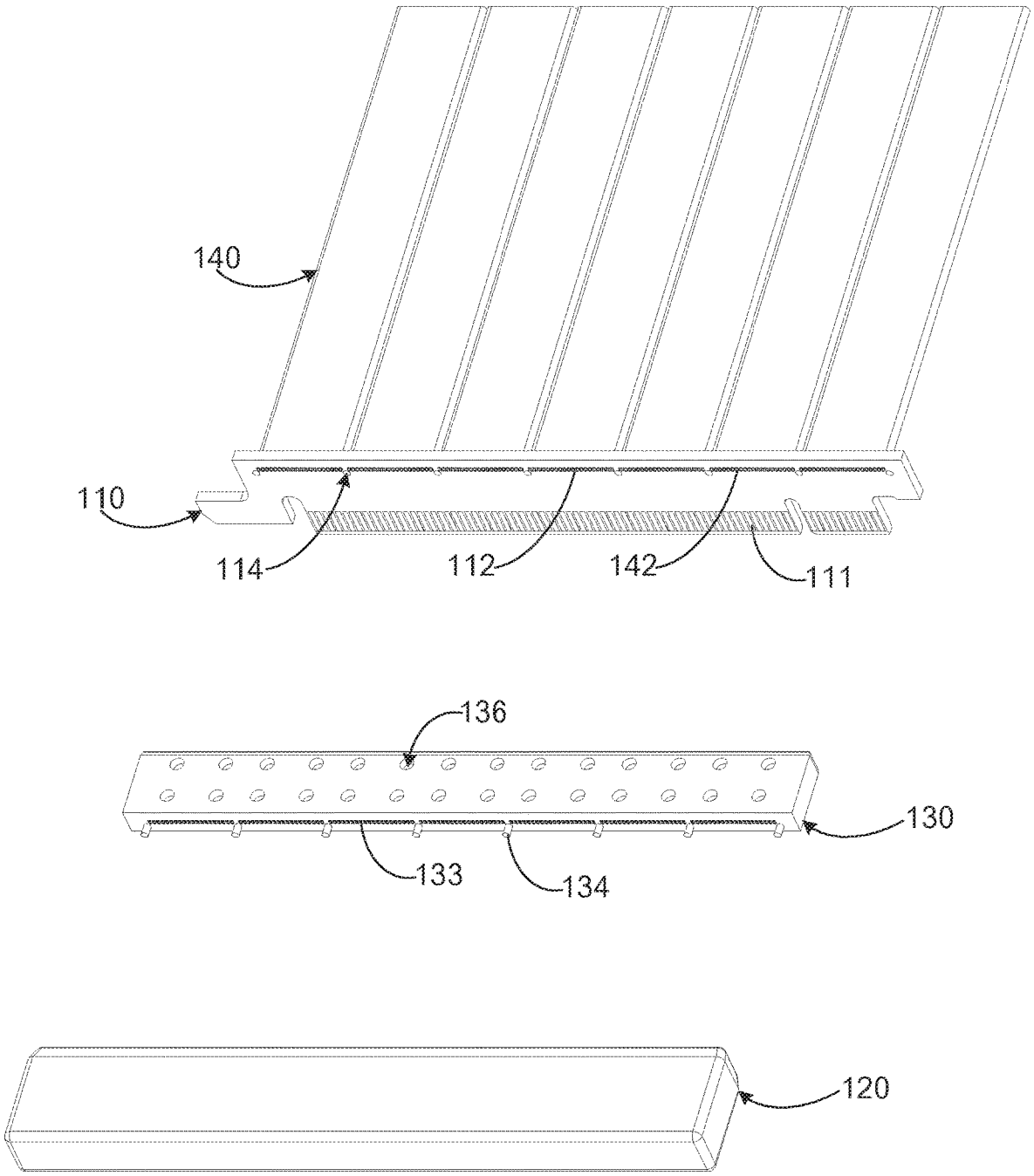

A description is provided with reference to FIG. 5 and FIG. 6. FIG. 5 and FIG. 6 are structural views of the adaptor 100 viewed from two opposite view angles when the flat cable 140 is connected to the substrate 110 in the exploded views of FIG. 1 and FIG. 2. The adaptor 100 comprises the substrate 110, the first housing 120, the second housing 130 and the flat cable 140. The substrate 110 comprises the abutting portion 111, the terminal holes 112 and the openings 114. The first housing 120 comprises the second insertion hole 122. The second housing 130 comprises the third insertion hole 132, the fourth insertion hole 133, the positioning pillars 134, and the recesses 136. The flat cable 140 comprises the plurality of conductors 141. Each of the conductors 141 comprises the conductor terminal 142. The conductor terminals 142 of the flat cable 140 are connected to the terminal holes 112 of the substrate 110. The flat cable 140 and the terminal holes 112 are perpendicularly connected.

Figure 7:
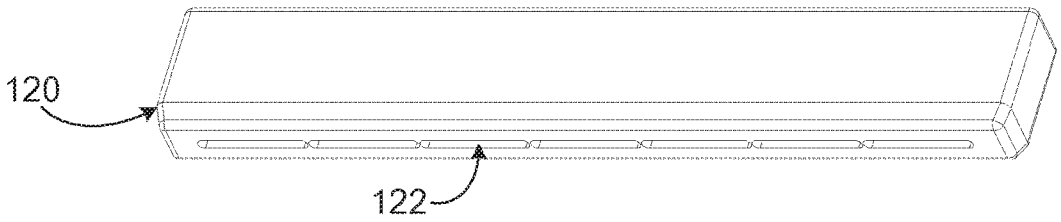
FIG. 7 and FIG. 8 are structural views of the adaptor viewed from two opposite view angles after the second housing is assembled to the flat cable in the structural views of FIG. 5 and FIG. 6.
Figure 7:
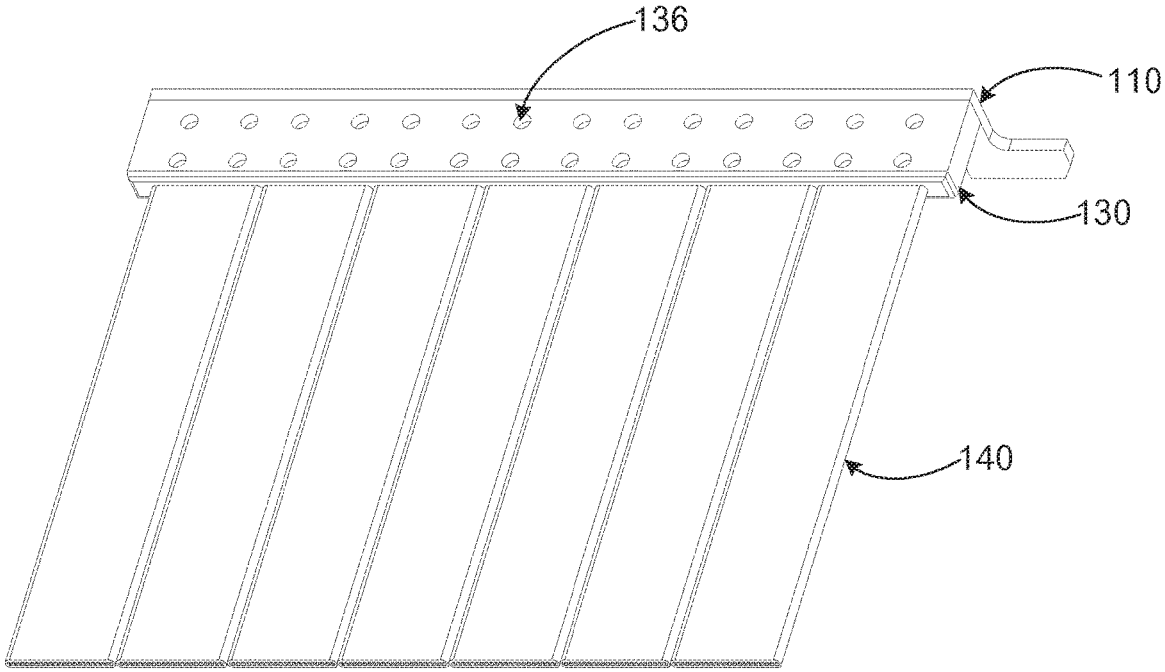
Figure 8:
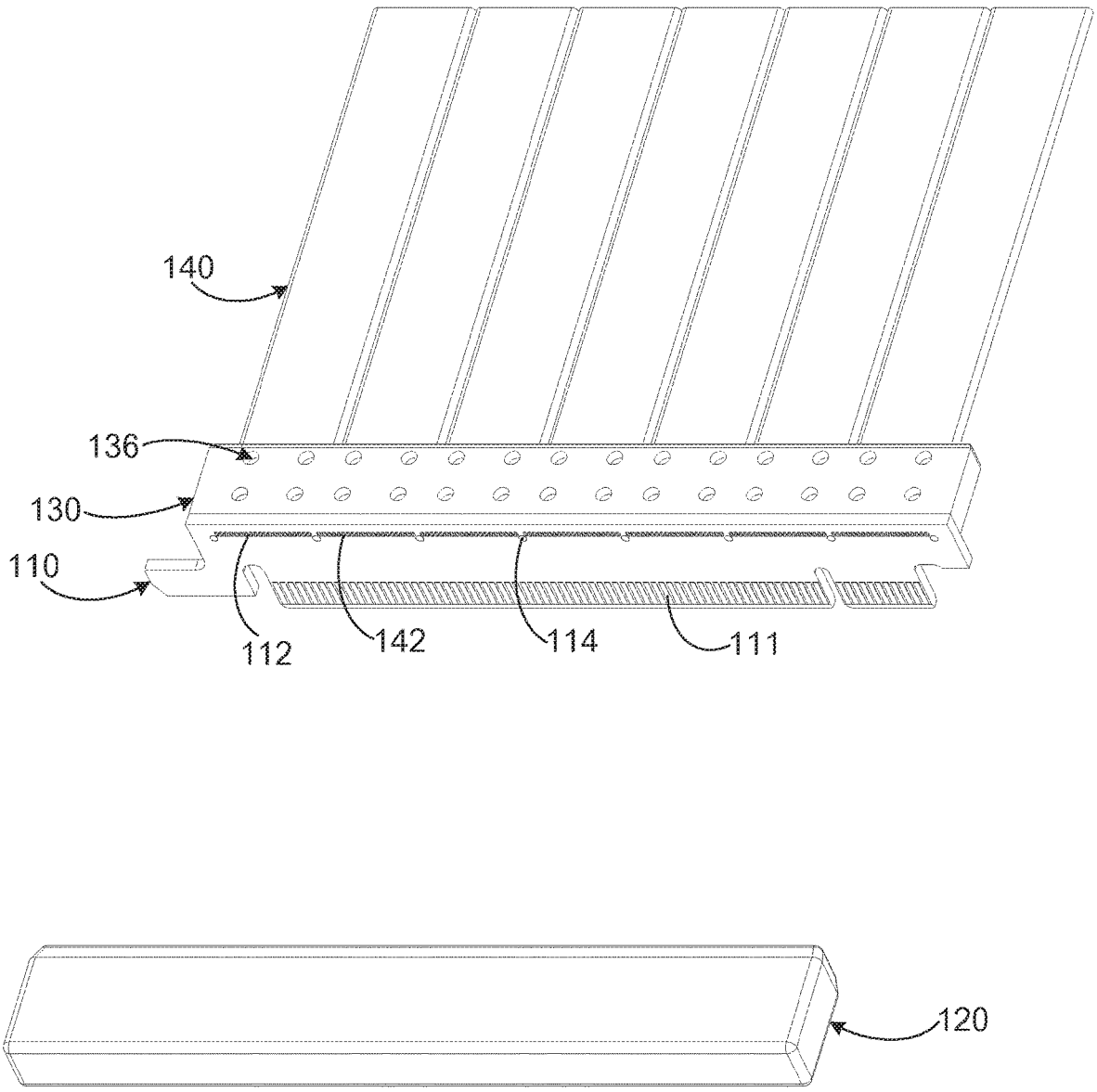

FIG. 7 and FIG. 8 are structural views of the adaptor 100 viewed from two opposite view angles after the second housing 130 is assembled to the flat cable 140 in FIG. 5 and FIG. 6. The adaptor 100 comprises the substrate 110, the first housing 120, the second housing 130 and the flat cable 140. The substrate 110 comprises the abutting portion 111, the terminal holes 112 and the openings 114. The first housing 120 comprises the second insertion hole 122. The second housing 130 comprises the third insertion hole 132, the fourth insertion hole 133, the positioning pillars 134, and the recesses 136. The flat cable 140 comprises the plurality of conductors 141. Each of the conductors 141 comprises the conductor terminal 142. The flat cable 140 passes through the third insertion hole 132 of the second housing 130. The conductor terminals 142 of the flat cable 140 pass through the fourth insertion hole 133 of the second housing 130. The conductor terminals 142 are connected to the terminal holes 112 of the substrate 110. The positioning pillars 134 of the second housing 130 are inserted into the openings 114 on the substrate 110 for fixing the flat cable 140 and the substrate 110.

Figure 9:
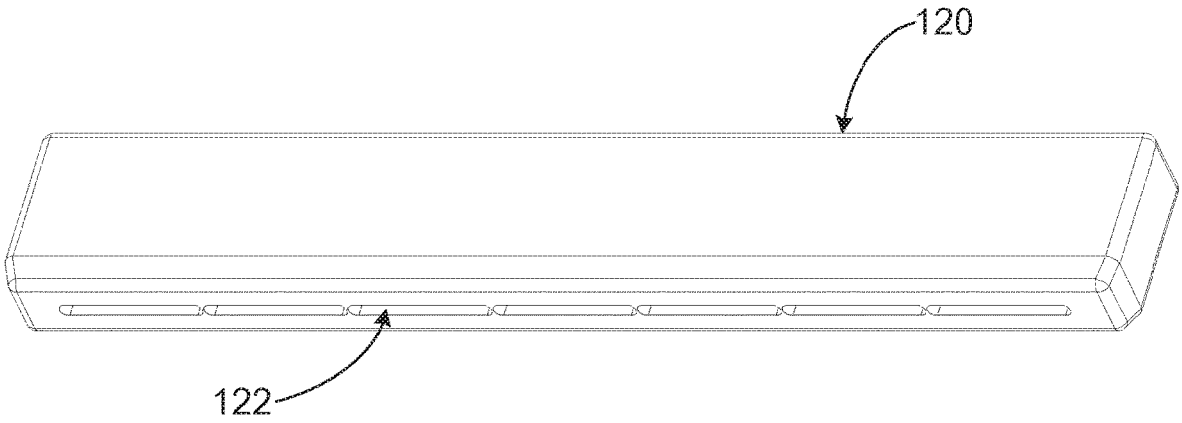
FIG. 9 is a perspective view of the first housing in FIG. 1.
Figure 11:
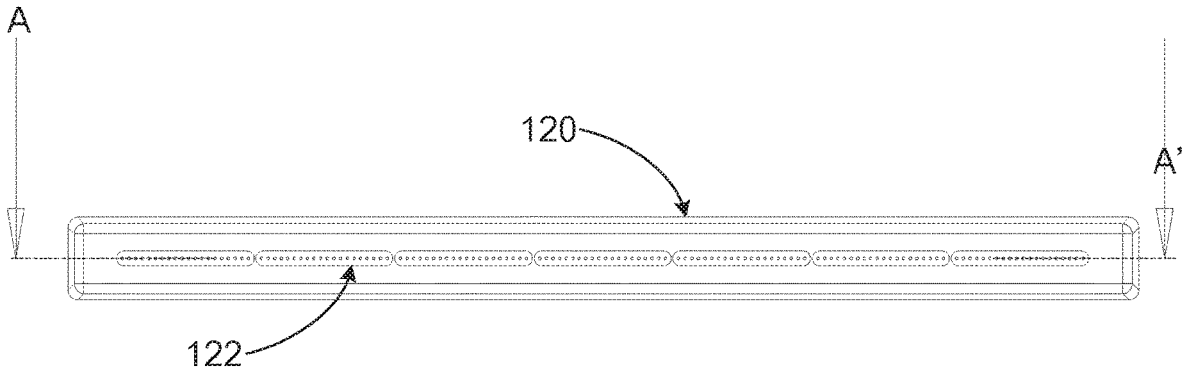
FIG. 11 is a front view of the first housing in FIG. 9.
Figure 12:
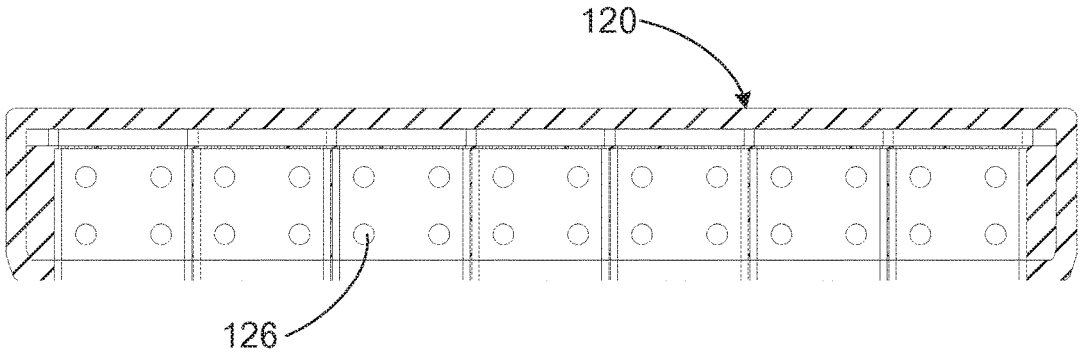
FIG. 12 is a cross-sectional view of the first housing in FIG. 11 taken along line A-A'.

A description is provided with reference to FIG. 1, FIG. 9, FIG. 10, FIG. 11 and FIG. 12. FIG. 9 is a perspective view of the first housing 120. FIG. 10 is a perspective view of the first housing in FIG. 9 view from another view angle. FIG. 11 is a front view of the first housing 120 in FIG. 9. FIG. 12 is a cross-sectional view of the first housing in FIG. 11 taken along line A-A'. The first housing 120 comprises the first insertion hole 121, the second insertion hole 122, and a pair of protrusions 126. The first insertion hole 121 is used to allow the substrate 110 to be inserted into the first housing 120. The second insertion hole 122 is used to allow the flat cable 140 to be inserted into the first housing 120. The pair of protrusions 126 are used for being inserted into the recesses 136 of the second housing 130 so that the first housing 120 and the second housing 130 hold each other. The direction in which the substrate 110 is inserted into the first insertion hole 121 is perpendicular to the direction in which the flat cable 140 passes through the second insertion hole 122.

Figure 13:
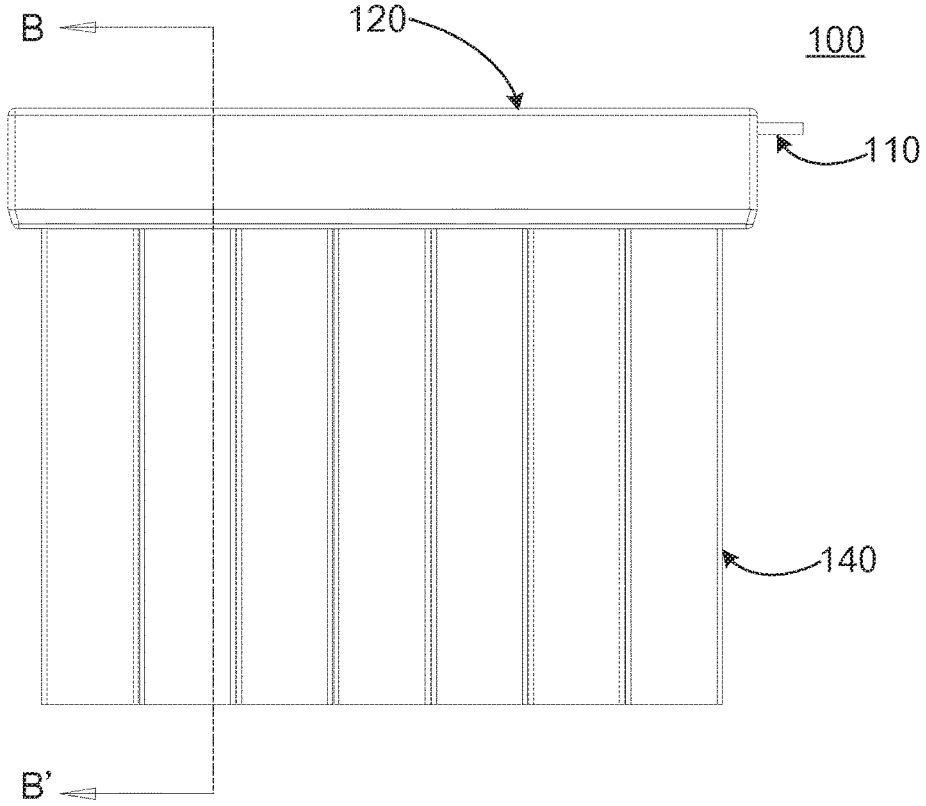
FIG. 13 is a front view of the adaptor in FIG. 3.
Figure 14:
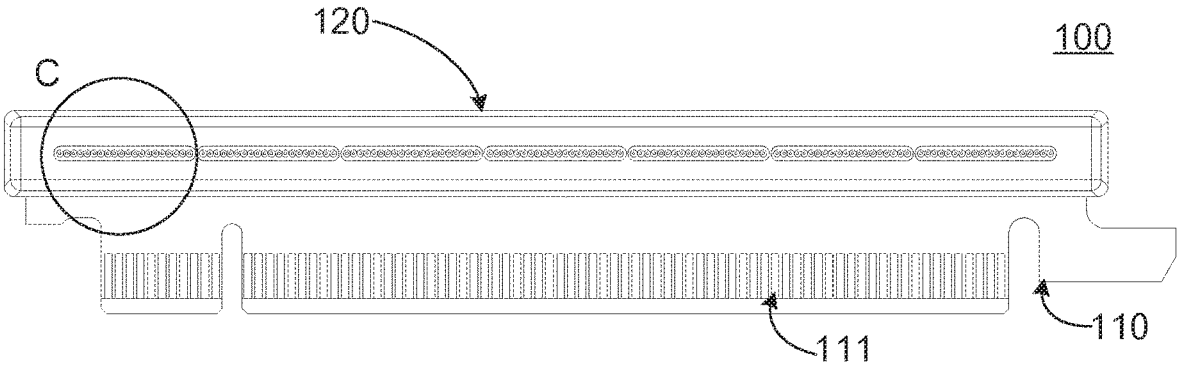
FIG. 14 is a bottom view of the adaptor in FIG. 3.
Figure 15:
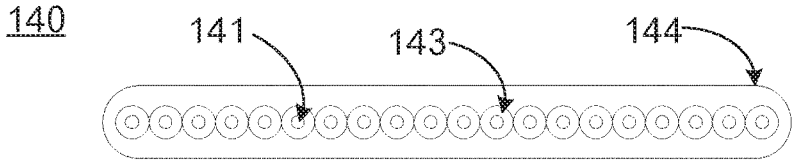
FIG. 15 is a partial enlarged view of an area C in FIG. 14.

A description is provided with reference to FIG. 1, FIG. 13, FIG. 14 and FIG. 15. FIG. 13 is a front view of the adaptor 100 in FIG. 3. FIG. 14 is a bottom view of the adaptor 100 in FIG. 3. FIG. 15 is a partial enlarged view of an area C in FIG. 14. The adaptor 100 comprises the substrate 110, the first housing 120, the second housing 130 and the flat cable 140. The substrate 110 comprises the abutting portion 111, the terminal holes 112 and the openings 114. The first housing 120 comprises the first insertion hole 121 and the second insertion hole 122. The second housing 130 comprises the third insertion hole 132, the fourth insertion hole 133, the positioning pillars 134, and the recesses 136. The flat cable 140 comprises the plurality of conductors 141. Each of the conductors 141 comprises the conductor terminal 142. The substrate 110 is inserted into the first housing 120 from the first insertion hole 121 of the first housing 120. The flat cable 140 passes through the third insertion hole 132 of the second housing 130 and the second insertion hole 122 of the first housing 120. The conductor terminals 142 of the flat cable 140 pass through the fourth insertion hole 133 of the second housing 130. The conductor terminals 142 are connected to the terminal holes 112 of the substrate 110. The positioning pillars 134 of the second housing 130 are inserted into the openings 114 on the substrate 110 for fixing the flat cable 140 and the substrate 110. The flat cable 140 comprises an outer cover 144 and the plurality of conductors 141. Each of the conductors 141 is encapsulated by an insulating material 143, and the outer cover 144 encapsulates the insulating material 143.

Figure 16:
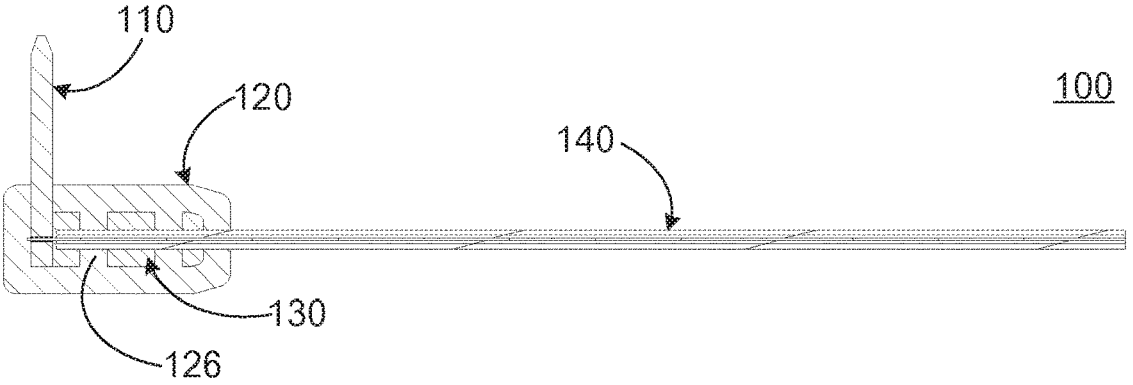
FIG. 16 is a cross-sectional view of the adaptor in FIG. 13 taken along line B-B'.

A description is provided with reference to FIG. 1, FIG. 2 and FIG. 16. FIG. 16 is a cross-sectional view of the adaptor 100 in FIG. 13 taken along line B-B'. The adaptor 100 comprises the substrate 110, the first housing 120, the second housing 130 and the flat cable 140. The substrate 110 comprises the abutting portion 111, the terminal holes 112 and the openings 114. The first housing 120 comprises the first insertion hole 121, the second insertion hole 122, and the pair of protrusions 126. The second housing 130 comprises the third insertion hole 132, the fourth insertion hole 133, the positioning pillars 134, and the recesses 136. The flat cable 140 comprises the plurality of conductors 141. Each of the conductors 141 comprises the conductor terminal 142. The substrate 110 is inserted into the first housing 120 from the first insertion hole 121 of the first housing 120. The flat cable 140 passes through the third insertion hole 132 of the second housing 130 and the second insertion hole 122 of the first housing 120. The conductor terminals 142 of the flat cable 140 pass through the fourth insertion hole 133 of the second housing 130. The conductor terminals 142 are connected to the terminal holes 112 of the substrate 110. The direction in which the substrate 110 is inserted into the first insertion hole 121 is perpendicular to the direction in which the flat cable 140 passes through the second insertion hole 122 and the third insertion hole 132. The positioning pillars 134 of the second housing 130 are inserted into the openings 114 on the substrate 110 for fixing the flat cable 140 and the substrate 110. The protrusions 126 of the first housing 120 are inserted into the recesses 136 of the second housing 130, so that the first housing 120 and the second housing 130 hold each other and the flat cable 140 is held.

Figure 17:
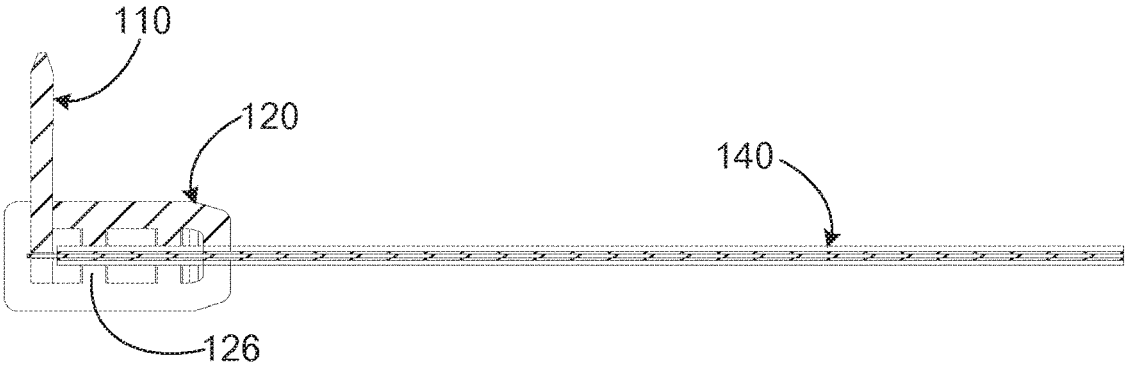
FIG. 17 is a cross-sectional view of the adaptor in FIG. 16 with the second housing being removed.

A description is provided with reference to FIG. 17. FIG. 17 is a cross-sectional view of the adaptor 100 in FIG. 16 with the second housing 130 being removed. The substrate 110 comprises the abutting portion 111, the terminal holes 112 and the openings 114. The first housing 120 comprises the first insertion hole 121, the second insertion hole 122, and the pair of protrusions 126. The flat cable 140 comprises the plurality of conductors 141. Each of the conductors 141 comprises the conductor terminal 142. The substrate 110 is inserted into the first housing 120 from the first insertion hole 121 of the first housing 120. The flat cable 140 passes through the second insertion hole 122 of the first housing 120. The conductor terminals 142 are connected to the terminal holes 112 of the substrate 110. The direction in which the substrate 110 is inserted into the first insertion hole 121 is perpendicular to the direction in which the flat cable 140 passes through the second insertion hole 122. The protrusions 126 of the first housing 120 hold the flat cable 140.

Figure 18:
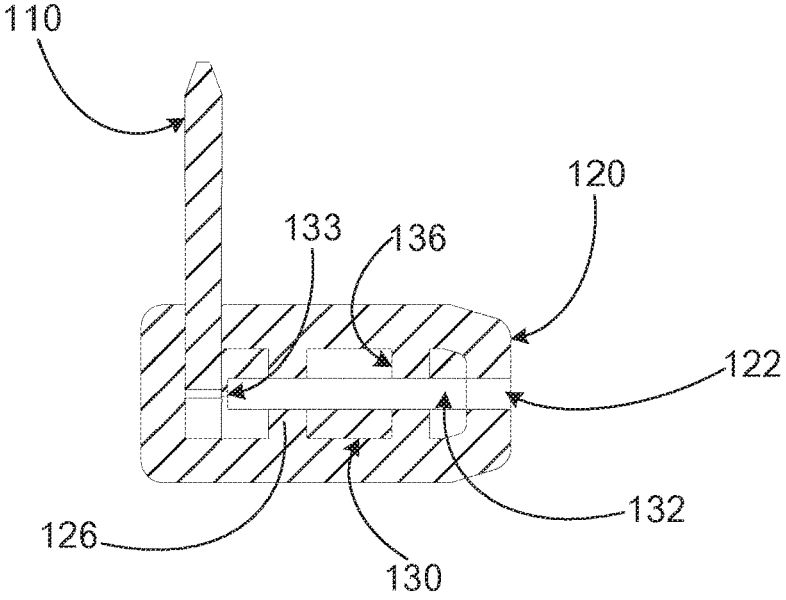
FIG. 18 is a cross-sectional view of the adaptor in FIG. 16 with the flat cable being removed.
Figure 19:
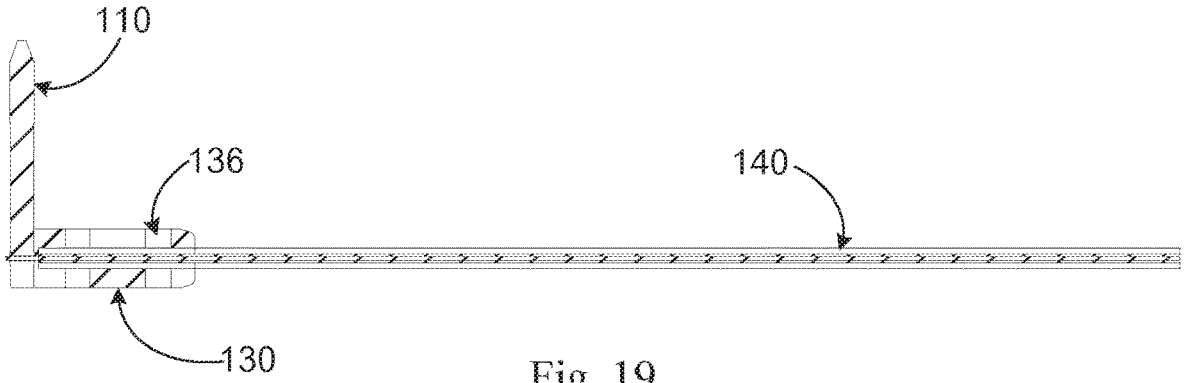
FIG. 19 is a cross-sectional view of the adaptor in FIG. 16 with the first housing being removed.

A description is provided with reference to FIG. 18 and FIG. 19. FIG. 18 is a cross-sectional view of the adaptor 100 in FIG. 16 with the flat cable 140 being removed. FIG. 19 is a cross-sectional view of the adaptor 100 in FIG. 16 with the first housing 120 being removed. The first housing 120 comprises the first insertion hole 121, the second insertion hole 122, and the pair of protrusions 126. The second housing 130 comprises the third insertion hole 132, the fourth insertion hole 133, the positioning pillars 134, and the recesses 136. The substrate 110 is inserted into the first housing 120 from the first insertion hole 121 of the first housing 120. The protrusions 126 of the first housing 120 are inserted into the recesses 136 of the second housing 130, so that the first housing 120 and the second housing 130 hold each other.

Figure 20:
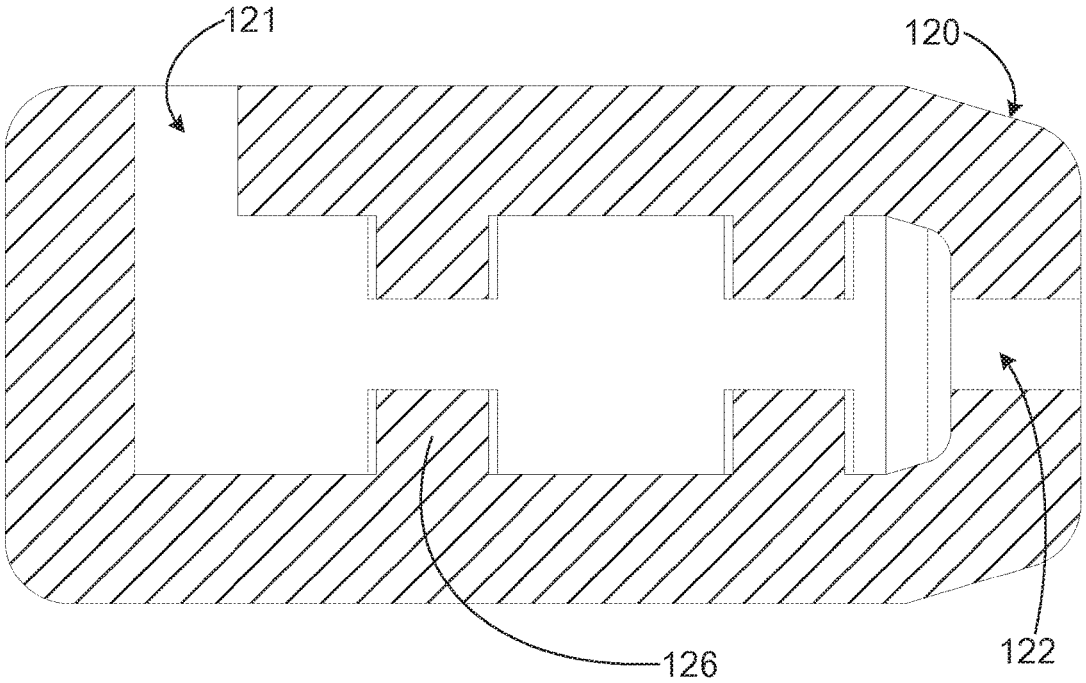
FIG. 20 is a cross-sectional view of the adaptor in FIG. 16 with only the first housing being retained.
Figure 21:
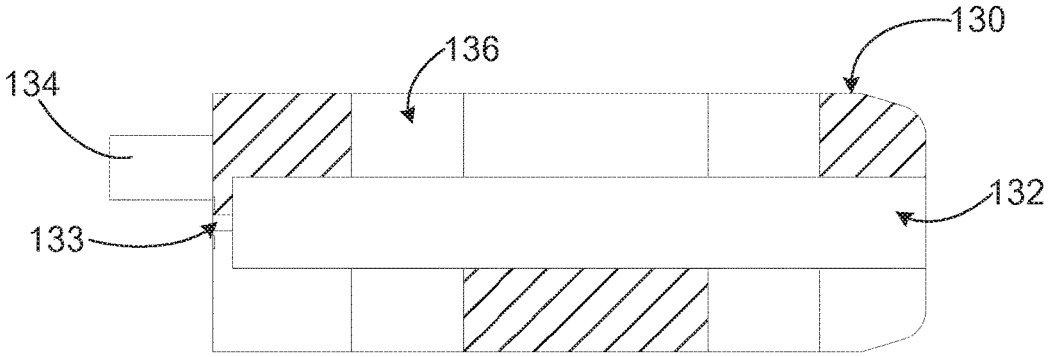
FIG. 21 is a cross-sectional view of the adaptor in FIG. 16 with only the second housing being retained.

A description is provided with reference to FIG. 1, FIG. 20 and FIG. 21. FIG. 20 is a cross-sectional view of the adaptor 100 in FIG. 16 with only the first housing 120 being retained. FIG. 21 is a cross-sectional view of the adaptor 100 in FIG. 16 with only the second housing 130 being retained. The first housing 120 comprises the first insertion hole 121, the second insertion hole 122, and the pair of protrusions 126. The second housing 130 comprises the third insertion hole 132, the fourth insertion hole 133, the positioning pillar 134, and the recesses 136. The protrusions 126 and the recesses 136 are fitted to each other so as to fasten the first housing 120 and the second housing 130 together. The substrate 110 is inserted into the first housing 120. The flat cable 140 passes through the second insertion hole 122 and the third insertion hole 132. The conductor terminals 142 of the flat cable 140 pass through the fourth insertion hole 133 and are connected to the terminal holes 112 of the substrate 110. The positioning pillars 134 of the second housing 130 are inserted into the openings 114 of the substrate 110. The direction in which the substrate 110 is inserted into the first insertion hole 121 is perpendicular to the direction in which the flat cable 140 passes through the second insertion hole 122.

According to the embodiment of the present disclosure, an adaptor 100 comprises a substrate 110, a first housing 120, and a flat cable 140. The substrate 110 comprises a terminal hole 112. The first housing 120 comprises a first insertion hole 121 and a second insertion hole 122. The substrate 110 is inserted into the first insertion hole 121. The flat cable 140 comprises a plurality of conductors 141. Each of the conductors 141 comprises a conductor terminal 142. The flat cable 140 passes through the second insertion hole 122. The conductor terminal 142 is connected to the terminal hole 112. A direction in which the substrate 110 is inserted into the first insertion hole 121 is perpendicular to a direction in which the flat cable 140 passes through the second insertion hole 122.

According to the embodiment of the present disclosure, the first housing 120 further comprises a pair of protrusions 126 in it, the pair of protrusions 126 hold the flat cable 140.

According to the embodiment of the present disclosure, two abutting portions 111 are respectively disposed on two surfaces of the substrate 110, each of the abutting portions 111 is used for mating a slot of a device.

According to the embodiment of the present disclosure, the adaptor 100 further comprises a second housing 130. The second housing 130 is disposed in the first housing 120. The second housing 130 comprises a third insertion hole 132.

According to the embodiment of the present disclosure, the second housing 130 further comprises a fourth insertion hole 133. The conductor terminal 142 passes through the fourth insertion hole 133 to be connected to the terminal hole 112.

According to the embodiment of the present disclosure, the flat cable 140 passes through the second insertion hole 122 and the third insertion hole 132, the conductor terminal 142 is connected to the terminal hole 112.

According to the embodiment of the present disclosure, the substrate 110 further comprises an opening 114, the second housing 130 further comprises a positioning pillar 134 passing through the opening 114.

According to the embodiment of the present disclosure, the second housing 130 further comprises a pair of recesses 136, the pair of protrusions 126 are inserted into the pair of recesses 136 to hold the flat cable 140.

As compared with the related art, not only can the adaptor 100 according to the present disclosure reduce the height of the product, but the length of the flat cable 140 is also shortened. This is because when the direction in which the substrate 110 is inserted into the first insertion hole 121 is perpendicular to the direction in which the flat cable 140 passes through the second insertion hole 122, the flat cable 140 can be directly connected to the terminal holes 112 on the substrate 110 without being bent, thus shortening the length required for the flat cable 140.

The present disclosure is described in detail in accordance with the above contents with the specific preferred examples. However, this present disclosure is not limited to the specific examples. For the ordinary technical personnel of the technical field of the present disclosure, on the premise of keeping the conception of the present disclosure, the technical personnel can also make simple deductions or replacements, and all of which should be considered to belong to the protection scope of the present disclosure.

What is claimed is:

1. An adaptor comprising:

a substrate comprising a terminal hole and two abutting portions;

a first housing comprising a first insertion hole and a second insertion hole, the substrate being inserted into the first insertion hole;

a second housing, the second housing being disposed in the first housing, the second housing comprising a third insertion hole; and a flat cable comprising a plurality of conductors, each of the conductors comprising a conductor terminal, the flat cable passing through the second insertion hole, the conductor terminal being inserted into the terminal hole to be perpendicularly connected to the terminal hole;

wherein a direction in which the substrate is inserted into the first insertion hole is perpendicular to a direction in which the flat cable passes through the second insertion hole.

2. The adaptor as claimed in claim 1, wherein the first housing further comprises a pair of protrusions, the pair of protrusions hold the flat cable.

3. The adaptor as claimed in claim 1, wherein the two abutting portions are respectively disposed on two surfaces of the substrate.

4. The adaptor as claimed in claim 1, wherein the second housing further comprises a fourth insertion hole, the conductor terminal passes through the fourth insertion hole to be connected to the terminal hole.

5. The adaptor as claimed in claim 1, wherein the flat cable passes through the second insertion hole and the third insertion hole, the conductor terminal is connected to the terminal hole.

6. The adaptor as claimed in claim 1, wherein the substrate further comprises an opening, the second housing further comprises a positioning pillar, the positioning pillar passes through the opening.

7. The adaptor as claimed in claim 1, wherein the first housing further comprises a pair of protrusions, the pair of protrusions hold the flat cable.

8. The adaptor as claimed in claim 7, wherein the second housing further comprises a pair of recesses, the pair of protrusions are inserted into the pair of recesses to hold the flat cable.

* * * * *